US007156720B2

(12) United States Patent
Saito et al.

(10) Patent No.: US 7,156,720 B2
(45) Date of Patent: Jan. 2, 2007

(54) SUBSTRATE HOLDING APPARATUS

(75) Inventors: Koji Saito, Tokyo (JP); Katsumi Sameshima, Kyoto (JP)

(73) Assignees: Ebara Corporation, Tokyo (JP); Rohm Co., Ltd., Kyoto (JP)

( * ) Notice: Subject to any disclaimer, the term of this patent is extended or adjusted under 35 U.S.C. 154(b) by 0 days.

(21) Appl. No.: 11/082,729

(22) Filed: Mar. 18, 2005

(65) Prior Publication Data

US 2005/0208880 A1 Sep. 22, 2005

(30) Foreign Application Priority Data

Mar. 19, 2004 (JP) ..... 2004-79658

(51) Int. Cl.
*B24B 49/00* (2006.01)

(52) U.S. Cl. ..... 451/11; 451/7; 451/53; 451/287

(58) Field of Classification Search ..... 451/11, 451/41, 53, 285–289, 388, 398, 7, 449
See application file for complete search history.

(56) References Cited

U.S. PATENT DOCUMENTS

| | | | | |
|---|---|---|---|---|
| 2,253,866 | A * | 8/1941 | Quoos | 236/1 E |
| 5,938,512 | A * | 8/1999 | Takei et al. | 451/388 |
| 6,012,967 | A * | 1/2000 | Satake et al. | 451/36 |
| 6,059,921 | A * | 5/2000 | Kato et al. | 156/345.12 |
| 6,077,437 | A * | 6/2000 | Hayashi et al. | 210/651 |
| 6,354,922 | B1 * | 3/2002 | Sakurai et al. | 451/67 |
| 6,402,597 | B1 * | 6/2002 | Sakurai et al. | 451/56 |
| 6,416,402 | B1 * | 7/2002 | Moore | 451/60 |
| 6,419,558 | B1 * | 7/2002 | Watanabe et al. | 451/41 |
| 6,645,050 | B1 * | 11/2003 | Butterfield et al. | 451/41 |
| 6,726,529 | B1 * | 4/2004 | Marcyk et al. | 451/7 |
| 2002/0042246 | A1 * | 4/2002 | Togawa et al. | 451/288 |
| 2002/0160702 | A1 * | 10/2002 | Kishida et al. | 451/285 |
| 2002/0187728 | A1 * | 12/2002 | Kiuchi et al. | 451/5 |
| 2003/0027506 | A1 * | 2/2003 | Herb et al. | 451/60 |
| 2003/0203708 | A1 * | 10/2003 | Liu et al. | 451/53 |
| 2004/0198184 | A1 * | 10/2004 | Joslyn | 451/5 |
| 2005/0054272 | A1 * | 3/2005 | Takahashi et al. | 451/41 |
| 2005/0191949 | A1 * | 9/2005 | Kamimura et al. | 451/56 |

FOREIGN PATENT DOCUMENTS

| | | |
|---|---|---|
| JP | 11-307486 | 11/1999 |
| JP | 2000-353677 | 12/2000 |

* cited by examiner

*Primary Examiner*—David B. Thomas
*Assistant Examiner*—Robert Scruggs
(74) *Attorney, Agent, or Firm*—Wenderoth, Lind & Ponack, L.L.P.

(57) ABSTRACT

A substrate holding apparatus can accurately control temperature of a substrate in a direct manner with a relatively simple arrangement. The substrate holding apparatus has a top ring configured to hold a substrate to be polished and press the substrate against a polishing surface, and an air bag attached to the top ring so as to be brought into contact with a rear face of the substrate. The substrate holding apparatus also has a regulator operable to regulate a temperature control fluid to be supplied into the air bag, and a flow regulating valve operable to regulate a flow rate of the temperature control fluid discharged from the air bag.

18 Claims, 6 Drawing Sheets

SUBSTRATE HOLDING APPARATUS

BACKGROUND OF THE INVENTION

1. Field of the Invention

The present invention relates to a substrate holding apparatus, and more particularly to a substrate holding apparatus in a chemical mechanical polishing apparatus for polishing a substrate such as a semiconductor wafer to a flat mirror finish.

2. Description of the Related Art

As semiconductor devices have become more highly integrated in recent years, circuit interconnections have become finer and distances between those circuit interconnections have become smaller. In a case of photolithography, which can form interconnections that are at most 0.5 μm wide, it is required that surfaces on which pattern images are to be focused by a stepper should be as flat as possible because depth of focus of an optical system is relatively small. In order to planarize such a semiconductor wafer, there has been used a polishing apparatus for performing chemical mechanical polishing (CMP).

This type of chemical mechanical polishing apparatus comprises a polishing table having a polishing pad (polishing cloth) attached to an upper surface of the polishing table, and a top ring for holding a substrate to be polished, such as a semiconductor wafer. The polishing table and the top ring are rotated at independent rotational speeds, respectively. The top ring presses the substrate against the polishing pad under a predetermined pressure. A polishing liquid (slurry) is supplied from a polishing liquid supply nozzle onto the polishing pad. Thus, a surface of the substrate is polished to a flat mirror finish.

FIG. 1 is a schematic view showing a main portion of a conventional polishing apparatus. The conventional polishing apparatus includes a rotatable polishing table (turntable) 102 having a polishing pad (polishing cloth) 100 attached to an upper surface of the polishing table 102, a top ring 104 for holding a semiconductor wafer (substrate) W, and a polishing liquid supply nozzle 106 for supplying a polishing liquid Q to the polishing pad 100. The top ring 104 is configured to rotate the semiconductor wafer W and press the semiconductor wafer W against the polishing pad 100. The top ring 104 is connected to a top ring shaft 108, which is vertically movable via an air cylinder provided in a top ring head (not shown).

The top ring 104 has an elastic pad 110 attached to a lower surface of the top ring 104. For example, the elastic pad is made of polyurethane. The semiconductor wafer W is held by the top ring 104 in a state such that the semiconductor wafer W is brought into contact with the elastic pad 110. Further, the top ring 104 has a cylindrical guide ring 112 provided at a peripheral portion of the top ring 104. The guide ring 112 serves to prevent the semiconductor wafer W from being separated from the lower surface of the top ring 104 during polishing. The guide ring 112 is fixed to the peripheral portion of the top ring 104. The guide ring 112 has a lower end located at a position lower than a holding surface of the top ring 104, and accordingly, forms a recessed portion at an inward position of the guide ring 112. Thus, a semiconductor wafer W to be polished is held within the recessed portion of the top ring 104 so as not to be ejected from the top ring 104 during polishing.

With the conventional polishing apparatus, the semiconductor wafer W is held on a lower surface of the elastic pad 110 in the top ring 104 and pressed against the polishing pad 100 on the polishing table 102 by the top ring 104. The polishing table 102 and the top ring 104 are rotated so as to move the polishing pad 100 and the semiconductor wafer W from the polishing liquid supply nozzle 106. For example, a suspension of fine abrasive particles in an alkali solution is used as the polishing liquid. Thus, the semiconductor wafer W is polished to a flat mirror finish by a combined effect of a chemical polishing effect attained by the alkali and a mechanical polishing effect attained by the abrasive particles.

In the aforementioned polishing apparatus, various complicated factors which may affect an amount of polishing should be controlled in order to planarize a semiconductor wafer W over an entire surface thereof with high accuracy. Such factors include a relative sliding speed between the semiconductor wafer W and the polishing table 102, an amount (or distribution) of polishing liquid at an interface (polishing interface) between the semiconductor wafer W and the polishing pad 100, a pressing force applied to the semiconductor wafer W to press the semiconductor wafer W against the polishing pad 100 by the top ring 104, a temperature of the polishing interface, and the like.

When an acid or alkali polishing liquid is used to perform a chemical mechanical polishing process (CMP), the temperature of the polishing interface exerts a great influence on a polishing rate. Additionally, if the top ring 104 is increased in temperature, the top ring 104 is deformed so as to exert an adverse influence on a pressing force. Thus, control of the temperature of the polishing interface has two aspects with respect to a level of planarization.

An example of a substrate holding apparatus including a means for controlling a temperature of a polishing interface is disclosed in Japanese laid-open patent publication No. 2000-225559, relevant parts of which are hereby incorporated by reference. Specifically, the substrate holding apparatus includes a holding plate having a substrate holding surface and an elastic pad attached to the holding surface of the holding plate. A substrate is held via the elastic pad on the substrate holding surface, and a surface of the substrate to be polished is pressed against a polishing surface on a polishing table. Grooves are formed in the substrate holding surface of the holding plate. The grooves are supplied with a fluid controlled in terms of temperature. Thus, a temperature of the substrate is controlled via the elastic pad.

FIG. 2 is a cross-sectional view showing a substrate holding apparatus having fluid communication grooves 128 for temperature control as disclosed in Japanese laid-open patent publication No. 2000-225559. In FIG. 2, components are illustrated in a simplified manner for easy understanding. As shown in FIG. 2, the substrate holding apparatus has a top ring 104 for holding a wafer W to be polished, an elastic pad 110 attached to a lower surface of the top ring 104, and pressure control units (regulators) 125 for controlling a pressure of a temperature control fluid 129. A plurality of communication grooves 128 are formed in the top ring 104. The temperature control fluid 129 is supplied through the pressure control unit 125 into the communication grooves 128 so as to cool a lower surface of the top ring 104. Because a cooling effect is transmitted to the wafer W via the elastic pad 110 by heat conduction, the cooling effect is adversely reduced by the elastic pad 110.

Further, no flow regulating valve is provided downstream of the communication grooves 128, but the regulators 125 are provided downstream of the communication grooves 128. Accordingly, the temperature control fluid 129 is supplied to the communication grooves 128 only when pressure of a fluid in the communication grooves 128 is lowered. Thus, the cooling effect is unsatisfactory in the conventional substrate holding apparatus. Furthermore, because the temperature control fluid 129 may leak from a periphery of the elastic pad 110 into the wafer W to cause uneven temperature control and contamination of the wafer W, a liquid cannot be used as the temperature control fluid 129.

Additionally, it is necessary to form a plurality of communication grooves 128 in the top ring 104 and further form a plurality of passages for allowing the temperature control fluid 129 to flow through the communication grooves 128. Thus, many troublesome processes are required to form grooves and holes, and a structure of the top ring 104 becomes complicated. Accordingly, use of the communication grooves 128 is effective rather in applying a back pressure to a rear face of the wafer W.

In order to solve the above drawbacks, there has been proposed a substrate holding apparatus having an air bag as shown in FIG. 3. The substrate holding apparatus has a top ring 104 for holding a wafer W on a lower surface thereof, a top ring shaft 108 for rotating the top ring 104, and an air bag 124 provided in the top ring 104 in a manner such that the wafer W is brought into contact with the air bag 124. The air bag 124 is supplied with a fluid 129 controlled in terms of temperature through a regulator 125. While the substrate holding apparatus shown in FIG. 2 controls a temperature of the wafer W via the elastic pad 110, the substrate holding apparatus shown in FIG. 3 controls a temperature of a rear face of the wafer W directly by temperature control fluid 129 in the air bag 124. The air bag 124 in this substrate holding apparatus is mainly used to uniformly press the wafer W. Specifically, the regulator 125 is employed in order to adjust pressure of the air bag 124 at a predetermined value. Accordingly, fluid 129 flows into the air bag 124 only when an internal pressure of the air bag 124 is lower than the predetermined value.

Although the substrate holding apparatus shown in FIG. 3 is configured to directly control a temperature of the wafer, no attention is paid to discharge of the temperature control fluid 129 from the air bag 124. Accordingly, the temperature control fluid 129 above the rear face of the wafer W is not replaced and thus serves merely as a fluid for applying a back pressure to control a pressing force of the wafer W. As a result, the wafer W is increased in temperature according to a polishing process. In a case of a copper CMP (chemical mechanical polishing), if temperature of a wafer becomes greater than a certain value, a polishing rate is lowered, particularly, at a central portion of the wafer.

SUMMARY OF THE INVENTION

The present invention has been made in view of the above drawbacks. It is, therefore, an object of the present invention to provide a substrate holding apparatus which can accurately control temperature of a substrate in a direct manner with a relatively simple arrangement.

According to a first aspect of the present invention, there is provided a substrate holding apparatus which can accurately control temperature of a substrate in a direct manner with a relatively simple arrangement. The substrate holding apparatus has a top ring configured to hold a substrate to be polished and press the substrate against a polishing surface, and an air bag attached to the top ring so as to be brought into contact with a rear face of the substrate. The substrate holding apparatus also has a regulator operable to regulate a temperature control fluid to be supplied into the air bag, and a flow regulating valve operable to regulate a flow rate of the temperature control fluid discharged from the air bag.

According to a second aspect of the present invention, there is provided a substrate holding apparatus which can accurately control temperature of a substrate in a direct manner with a relatively simple arrangement. The substrate holding apparatus has a top ring configured to hold a substrate to be polished and press the substrate against a polishing surface, and an air bag attached to the top ring so as to be brought into contact with a rear face of the substrate. The air bag includes a plurality of chambers. The substrate holding apparatus also has a plurality of regulators operable to regulate temperature control fluids to be supplied into corresponding chambers in the air bag, and a plurality of flow regulating valves operable to regulate flow rates of the temperature control fluids discharged from the corresponding chambers in the air bag. In this case, the substrate can be controlled in terms of temperature at each local area of the substrate.

According to the present invention, a fluid (gas or liquid) controlled in terms of temperature is supplied to the air bag near a rear face of the substrate (wafer) and discharged from the air bag. Thus, heat exchange can efficiently be performed to stabilize a temperature of the substrate for a long term of a chemical mechanical polishing (CMP) process.

The substrate holding apparatus may include a thermometer provided in the top ring or the air bag to measure a temperature of the substrate held by the top ring. The thermometer may monitor the temperature of the substrate held by the top ring. The substrate can be controlled in terms of temperature based on results monitored by the thermometer. The air bag may comprise a close-type air bag or an open-type air bag.

According to a third aspect of the present invention, there is provided a substrate holding apparatus which can accurately control temperature of a substrate in a direct manner with a relatively simple arrangement. The substrate holding apparatus has a top ring configured to hold a substrate to be polished and press the substrate against a polishing surface, and an air bag attached to the top ring so as to be brought into contact with a rear face of the substrate. The substrate holding apparatus also has a regulator operable to regulate a temperature control fluid to be supplied into the air bag, and a thermometer provided in the top ring or the air bag to measure a temperature of the substrate held by the top ring.

According to a fourth aspect of the present invention, there is provided a substrate holding apparatus which can accurately control temperature of a substrate in a direct manner with a relatively simple arrangement. The substrate holding apparatus has a top ring configured to hold a substrate to be polished and press the substrate against a polishing surface, and an air bag attached to the top ring so as to be brought into contact with a rear face of the substrate. The air bag includes a plurality of chambers. The substrate holding apparatus also has a plurality of regulators operable to regulate temperature control fluids to be supplied into corresponding chambers in the air bag, and a thermometer provided in the top ring or the air bag to measure a temperature of the substrate held by the top ring. In this case, the substrate can be controlled in terms of temperature at each local area of the substrate.

The thermometer may monitor the temperature of the substrate held by the top ring. The substrate can be controlled in terms of temperature based on results monitored by the thermometer. The air bag may comprise a close-type air bag or an open-type air bag.

The above and other objects, features, and advantages of the present invention will be apparent from the following description when taken in conjunction with the accompanying drawings which illustrate preferred embodiments of the present invention by way of example.

DETAILED DESCRIPTION OF THE PREFERRED EMBODIMENTS

Figure 1:
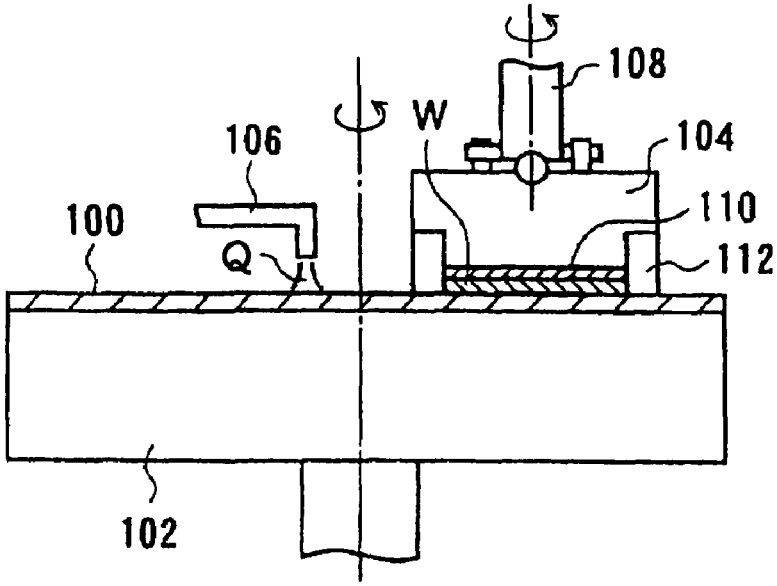
FIG. 1 (PRIOR ART)
FIG. 1 is a cross-sectional view showing a conventional polishing apparatus.
Figure 2:
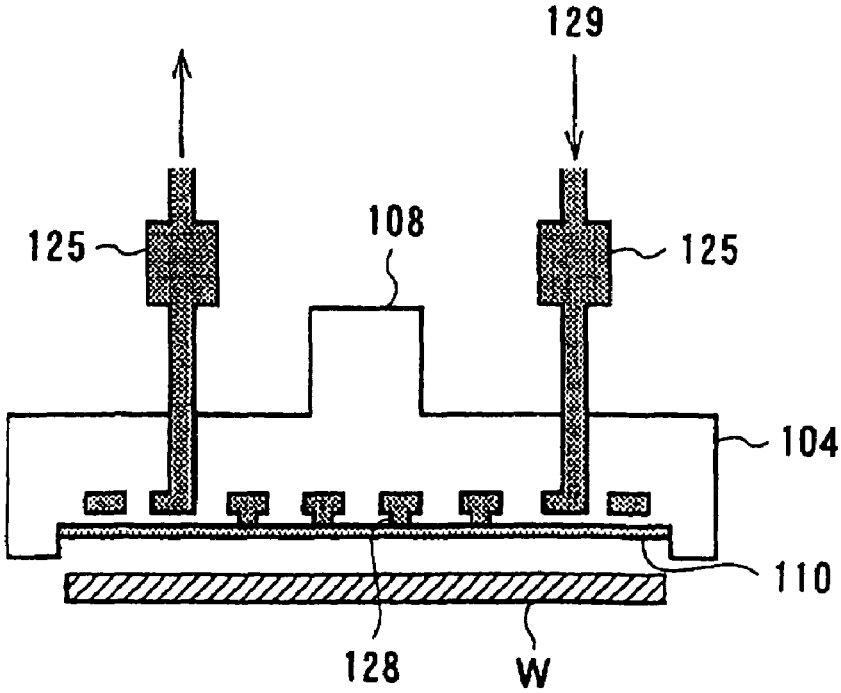
FIG. 2 (PRIOR ART)
FIG. 2 is a cross-sectional view showing a conventional substrate holding apparatus having a cooling mechanism for cooling a wafer.

A substrate holding apparatus according to embodiments of the present invention will be described below with reference to FIGS. 4 through 10. The present invention is not limited to the following embodiments. Like or corresponding parts are denoted by like or corresponding reference numerals throughout drawings, and will not be described below repetitively.

Figure 4:
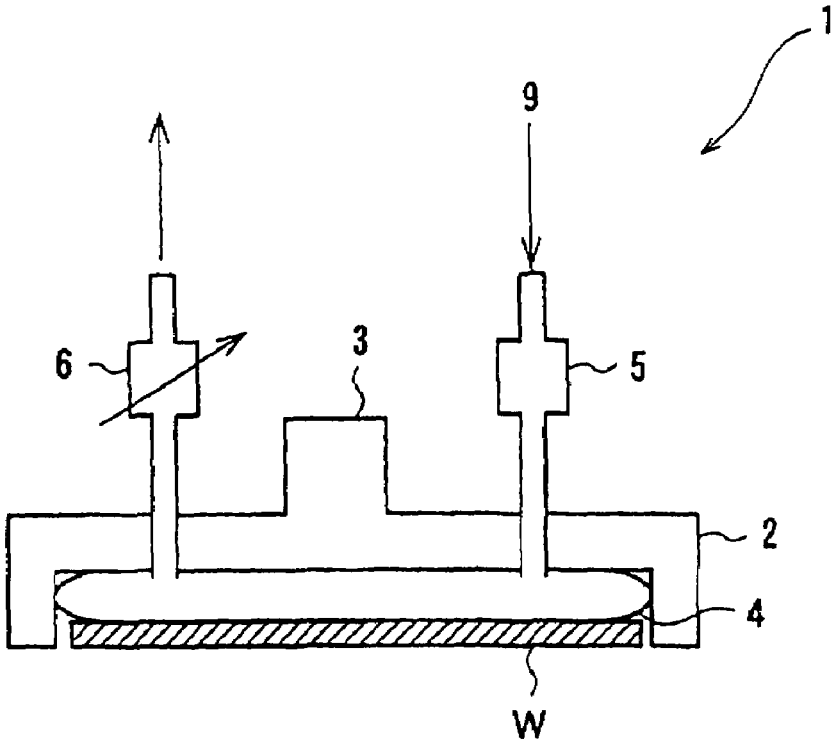
FIG. 4 is a cross-sectional view showing a substrate holding apparatus having a temperature control mechanism according to a first embodiment of the present invention.

FIG. 4 is a schematic view showing a substrate holding apparatus 1 according to a first embodiment of the present invention. The substrate holding apparatus 1 has a top ring 2 for holding a wafer W and pressing the wafer W against a polishing surface on a polishing table, a shaft 3 for rotating the top ring 2, an air bag 4 supplied with a temperature control fluid (fluid controlled in terms of temperature) 9, a regulator 5 for regulating the temperature control fluid 9, and a flow regulating valve (speed controller) 6 for regulating a flow rate of the temperature control fluid 9 discharged from the air bag 4. The temperature control fluid, the regulator 5, and the flow regulating valve 6 are configured to control a temperature of a space between the top ring 2 and a rear face of the wafer W. The temperature control fluid 9 above the rear face of the wafer W is replaced by a combination of the regulator 5, the flow regulating valve 6, and the air bag 4. A cooling device (not shown) is provided for cooling the fluid 9 to be supplied into the air bag 4 at a predetermined temperature. The temperature control fluid 9 may comprise a gas such as dry air, nitrogen gas, or helium gas, or a liquid such as water.

The air bag 4 presses the wafer W against a polishing table under a uniform pressure. The regulator 5 maintains and regulates a pressure of the air bag 4. The temperature control fluid 9 flows through the regulator 5 into the air bag 4. The temperature control fluid 9 in the air bag 4 is continuously or intermittently discharged by the flow regulating valve 6. Heat exchange is performed between the wafer W and the temperature control fluid 9. Thus, by adjusting the temperature of the temperature control fluid 9, the wafer W can be maintained at a predetermined temperature.

In the present embodiment, there is no elastic pad, which has poor heat conductivity. Heat conduction is performed via a thin film of the air bag 4. As a result, even if a CMP process is performed to polish a thick copper film for a long term, temperature increase is not caused. Accordingly, a high polishing rate can be maintained until completion of a polishing process. Further, even when a polishing process is performed at a high pressing force and a high rotational speed in order to increase a polishing rate, temperature increase can be prevented.

Figure 3:
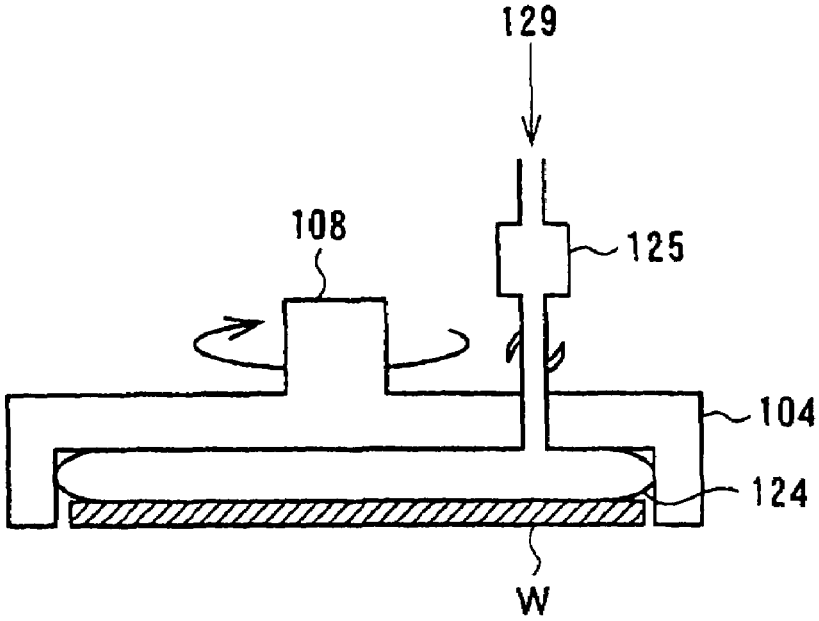
FIG. 3 (PRIOR ART)
FIG. 3 is a cross-sectional view showing a conventional substrate holding apparatus having an air bag.
Figure 5:
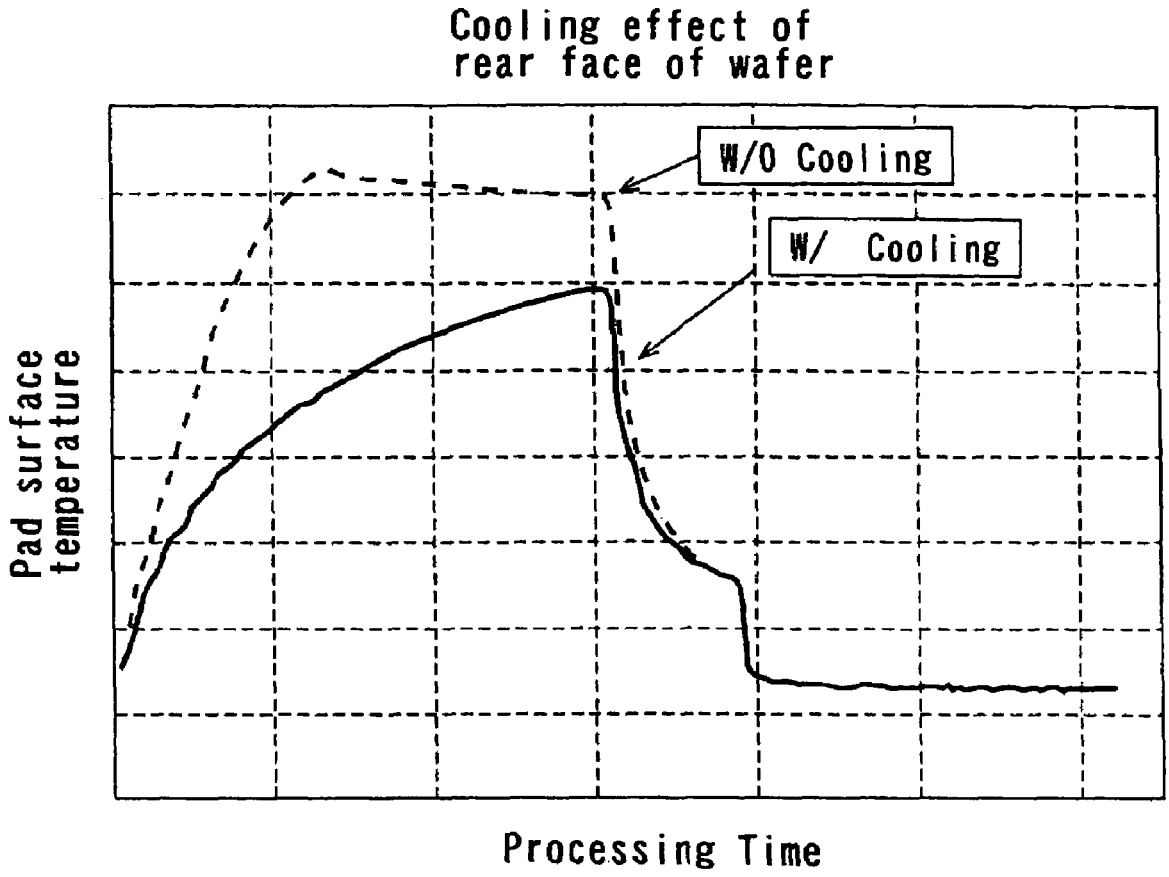
FIG. 5 is a graph showing comparison of pad surface temperatures between a case where a rear face of a wafer was cooled and a case where a rear face of a wafer was not cooled.

FIG. 5 is a graph showing temperatures of a polishing pad (polishing table) at a portion immediately after a wafer had passed above the portion. FIG. 5 shows measurement results in a case of the substrate holding apparatus 1 shown in FIG. 4 and the conventional substrate holding apparatus shown in FIG. 3. In the case of the substrate holding apparatus 1 shown in FIG. 4, a rear face of a wafer was cooled by the aforementioned structure. In the case of the conventional substrate holding apparatus shown in FIG. 3, a rear face of a wafer was not cooled because a fluid was not replaced in an air bag. It can be seen from FIG. 5 that temperature increase could be prevented when the rear face of the wafer was cooled. In the case where the rear face of the wafer was not cooled, temperature increase inhibited a reaction to thereby cause temperature decrease.

Figure 6:
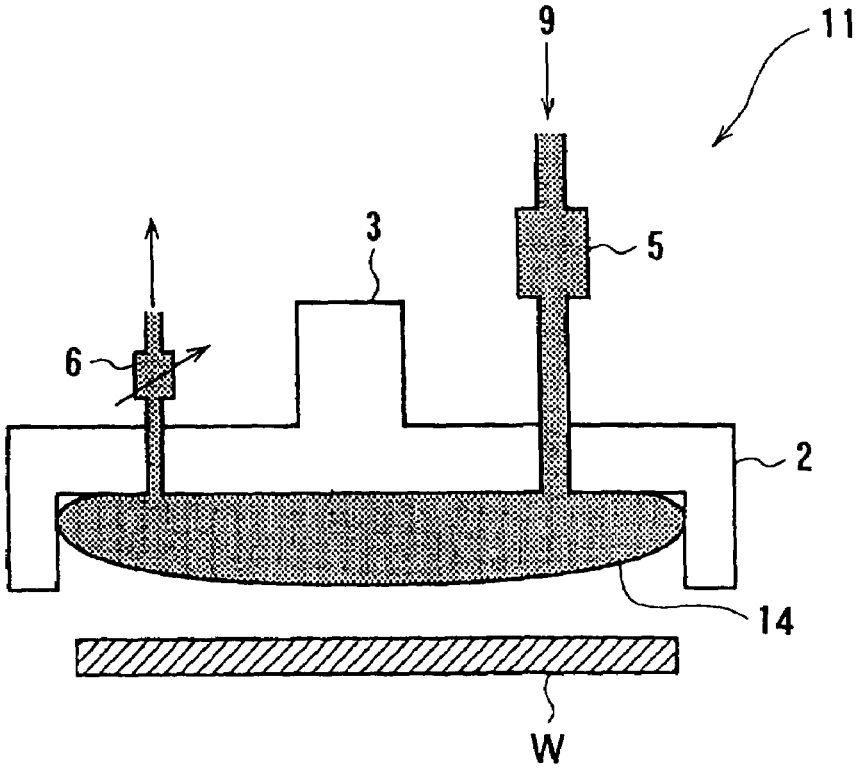
FIG. 6 is a cross-sectional view showing a substrate holding apparatus having a close-type air bag according to a second embodiment of the present invention.

FIG. 6 is a schematic view showing a substrate holding apparatus 11 employing a close-type air bag 14 according to a second embodiment of the present invention. FIG. 6 shows the substrate holding apparatus 11 before a wafer W is held on a holding surface of top ring 2. When a chemical mechanical polishing process is performed, the top ring 2 lowers a presser ring (not shown) downward by an air cylinder to press the presser ring against a polishing table (not shown) having a polishing pad attached thereon. Thus, a rear face of the wafer W is brought into close contact with a lower surface of the air bag 14. Details of such mechanisms are disclosed in Japanese laid-open patent publication No. 2000-225559.

As shown in FIG. 6, the close-type air bag 14 is of a balloon. Since a pressurized temperature control fluid 9 is hermetically sealed in the close-type air bag 14, the substrate holding apparatus 11 exhibits a good sealing performance. Since the pressurized temperature control fluid 9 is brought into contact with the rear face of the wafer W via the air bag 14, the substrate holding apparatus 11 has a heat conductivity lower than that of a substrate holding apparatus employing an open-type air bag, which is described below.

Figure 7:
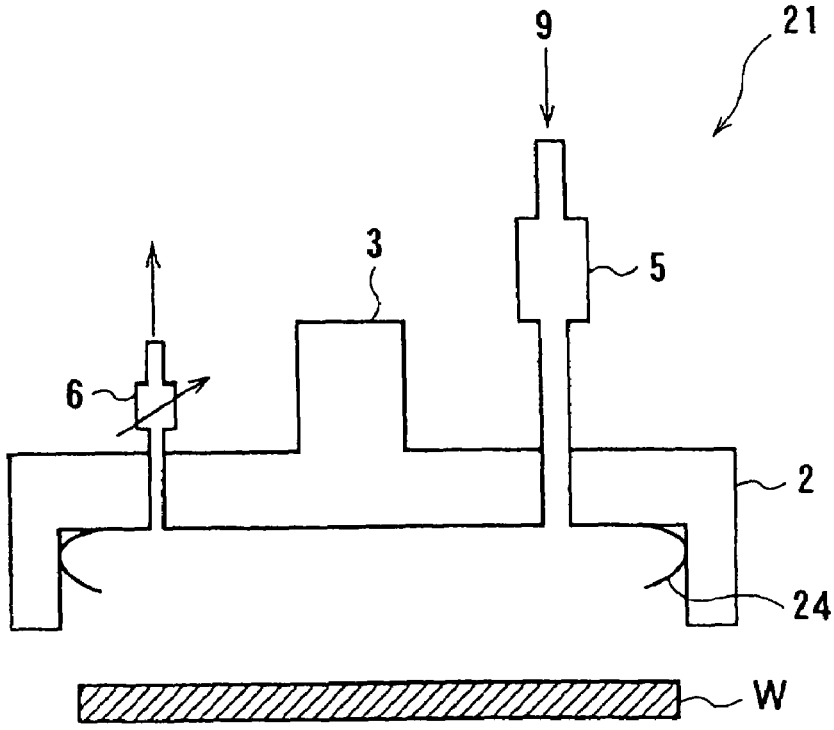
FIG. 7 is a cross-sectional view showing a substrate holding apparatus having an open-type air bag according to a third embodiment of the present invention.

FIG. 7 is a schematic view showing a substrate holding apparatus 21 employing an open-type air bag 24 according to a third embodiment of the present invention. FIG. 7 shows the substrate holding apparatus 21 before a wafer W is held on a holding surface of top ring 2 as in the case of FIG. 6.

When the wafer W is polished, a lower surface of the air bag 24 is brought into close contact with a rear face of the wafer W, as in the case of FIG. 6.

As shown in FIG. 7, the air bag 24 is open at a lower portion thereof. When the wafer W is polished, the air bag 24 is brought into contact with the wafer W at a peripheral portion of the air bag 24 to form a seal portion. Thus, a pressurized temperature control fluid is hermitically sealed in a sealed portion in the air bag 24. A sealing performance of the air bag 24 is less than that of a close-type air bag as shown in FIG. 6. However, since pressurized temperature control fluid 9 is brought into direct contact with the rear face of the wafer W, it is possible to achieve efficient heat exchange.

Figure 8A:
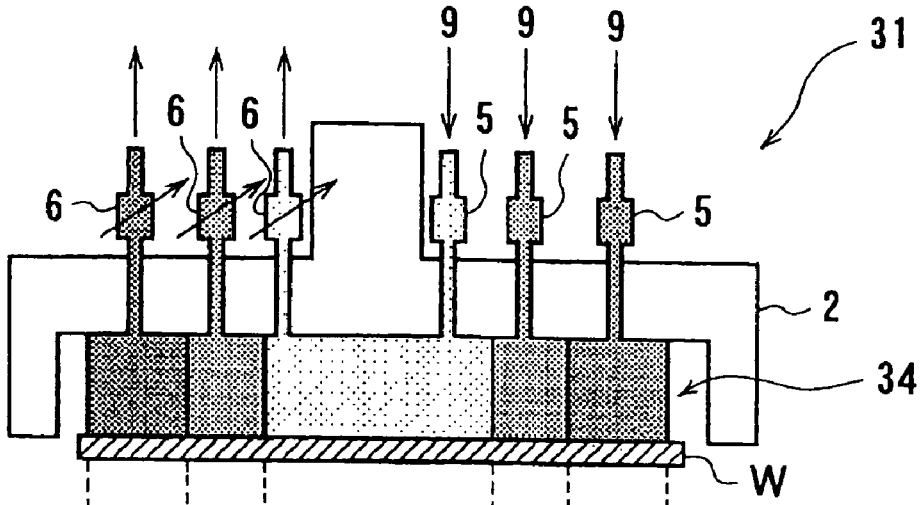
FIG. 8A is a cross-sectional view showing a substrate holding apparatus having divided chambers in an air bag according to a fourth embodiment of the present invention.
Figure 8B:
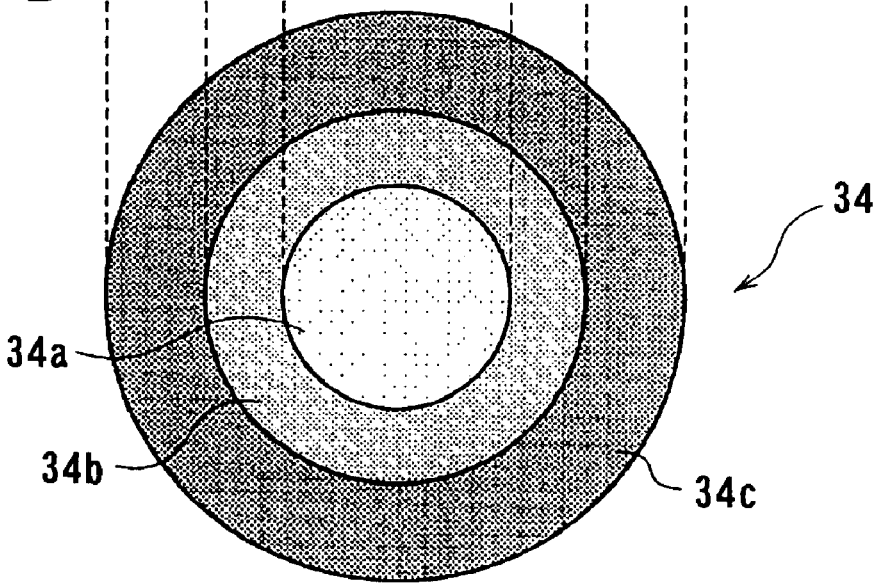
FIG. 8B is a plan view showing the divided chambers shown in FIG. 8A.

FIG. 8A is a cross-sectional view showing a substrate holding apparatus 31 employing a plurality of sets of regulators 5 and flow regulating valves 6 according to a fourth embodiment of the present invention. FIG. 8A shows the substrate holding apparatus 31 immediately before a wafer W is held on a holding surface of top ring 2. FIG. 8B is a plan view of an air bag in the substrate holding apparatus 31. The substrate holding apparatus 31 has an air bag 34 including a plurality of chambers 34*a*, 34*b*, and 34*c* divided in a radial direction. Temperature control fluids 9 are separately supplied into these divided chambers 34*a*, 34*b*, and 34*c* to thereby control a central portion, an intermediate portion, and a peripheral portion of the wafer W independently of each other.

The regulators 5 and the flow regulating valves 6 are provided so as to correspond to the divided chambers 34*a*, 34*b*, and 34*c*. Temperature control fluids 9 are supplied at different flow rates into the divided chambers 34*a*, 34*b*, and 34*c*, respectively. Thus, the central portion, the intermediate portion, and the peripheral of the wafer W can be cooled separately from each other.

With the air bag having the divided chambers 34*a*, 34*b*, and 34*c* to control a temperature of the wafer W, temperature control can be performed at respective areas of the wafer W. In a case of a copper CMP process, a polishing rate is lowered when the temperature of the wafer becomes larger than a certain value. Particularly, decrease of a polishing rate becomes significant at a central portion of a wafer when the temperature of the wafer is increased. According to the substrate holding apparatus 31 described above, the wafer W can intensively be cooled at the central portion thereof. Thus, it is possible to effectively prevent decrease of a polishing rate.

In the above embodiments, a fluid 9 controlled in temperature is introduced into the air bag to control the temperature of the wafer W. However, in order to perform accurate temperature control, it is necessary to measure the temperature of the wafer W to be polished. In a conventional polishing apparatus, because the surface of the wafer cannot directly be measured, a temperature of a polishing pad is measured at a position through which the wafer has passed to thereby measure the temperature of the wafer. To the contrary, in the substrate holding apparatus employing an air bag without any elastic pads, the temperature of the rear face of the wafer W can directly be measured. Accordingly, a thermometer may be provided in the top ring 2 to measure the temperature of the rear face of the wafer W in the above embodiments. When the temperature of the wafer W is monitored by the thermometer, temperature control of the wafer W can be performed more accurately.

If a thermometer provided in the top ring is brought into direct contact with the wafer, distortion is applied to the wafer W. Accordingly, a non-contact radiation thermometer is suitable for the thermometer to measure the temperature of the wafer W. It is desirable to use an infrared thermometer as a radiation thermometer. In the case of an infrared thermometer, an infrared ray permeates an Si wafer and is thus suitable only for a metal wafer. In the case of a radiation thermometer, when the air bag is made of a material which is permeated by electromagnetic radiation (including light ray), the temperature of the wafer W can sufficiently be measured even if a measurement end of the thermometer is located above the air bag. However, even a thin film of the air bag inhibits permeation of electromagnetic radiation to some extent. Accordingly, when an open-type air bag as shown in FIG. 7 is used, accuracy of measurement can be improved because there is no film on a rear face of the wafer W.

Figure 9:
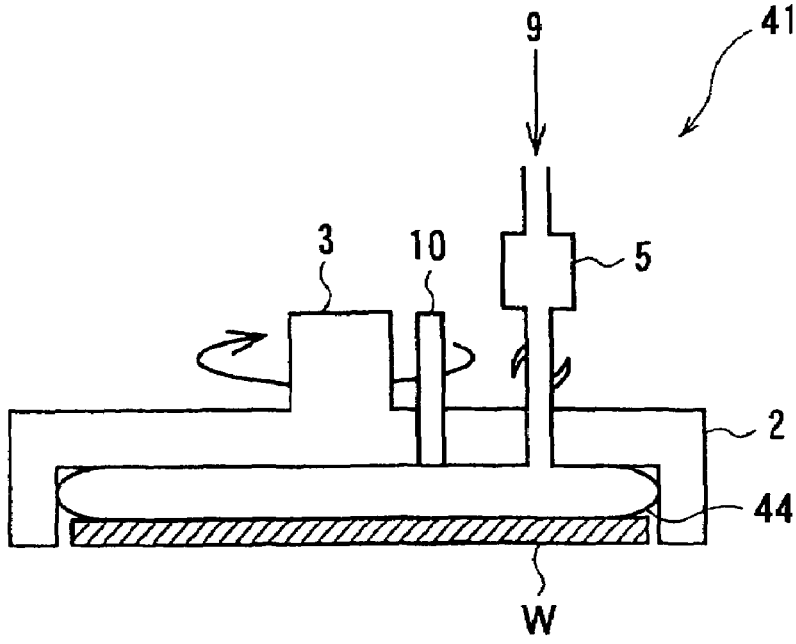
FIG. 9 is a cross-sectional view showing a substrate holding apparatus having a thermometer and an air bag into which a fluid controlled in terms of temperature is introduced according to a fifth embodiment of the present invention.

FIG. 9 is a schematic view showing a substrate holding apparatus 41 having a thermometer 10 in a top ring 2 according to a fifth embodiment of the present invention. When the thermometer 10 is provided in the substrate holding apparatus 41, it is not necessary to employ an air bag into which a fluid controlled in terms of temperature is supplied through a regulator and a flow regulating valve as shown in FIG. 4. Specifically, as shown in FIG. 9, a fluid 9 controlled in terms of temperature may simply be introduced into an air bag 44. In FIG. 9, the thermometer 10 is provided in the top ring 2 or in the air bag 44.

Figure 10:
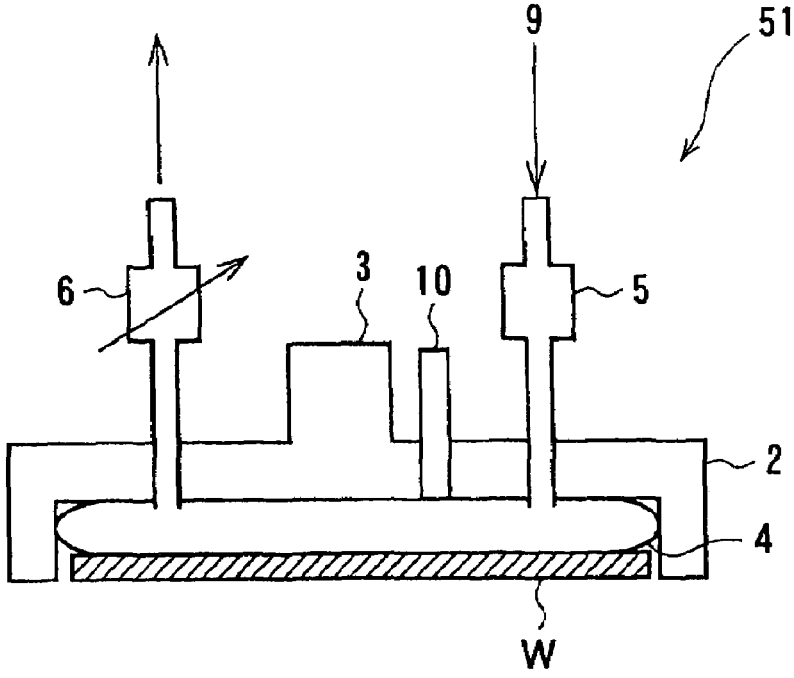
FIG. 10 is a cross-sectional view showing a substrate holding apparatus having a thermometer and an air bag through which a fluid controlled in terms of temperature flows according to a sixth embodiment of the present invention.

FIG. 10 is a schematic view showing a substrate holding apparatus 51 having a thermometer 10 in a top ring 2 or an air bag 4 according to a sixth embodiment of the present invention. The substrate holding apparatus 51 employs an air bag 4 into which a fluid 9 controlled in terms of temperature is supplied through a regulator 5 and a flow regulating valve 6 as with FIG. 4. In FIG. 10, the thermometer 10 is provided in the top ring 2 or in the air bag 4. Since the air bag 4 is supplied with a fluid 9 controlled in terms of temperature, it is possible to control a temperature of the wafer W more readily and more accurately.

As described above, according to a substrate holding apparatus for a chemical mechanical polishing (CMP) apparatus, a fluid controlled in terms of temperature is brought into contact with a rear face of a substrate to be polished in order to stabilize variation of temperature of the substrate during a CMP process. Accordingly, even if a CMP process is performed for a long term, temperature increase is not caused. Further, even when a polishing process is performed at a high pressing force and a high rotational speed in order to increase a polishing rate, temperature increase can be prevented. Accordingly, a high polishing rate can be maintained until completion of the polishing process. Thus, the present invention is useful for a substrate holding apparatus in a polishing apparatus for polishing highly integrated semiconductor wafers to a flat mirror finish.

Although certain preferred embodiments of the present invention have been shown and described in detail, it should be understood that various changes and modifications may be made therein without departing from the scope of the appended claims.

What is claimed is:

1. A substrate holding apparatus comprising:

a top ring configured to hold a substrate to be polished, and press the substrate against a polishing surface;

an air bag attached to said top ring so as to be brought into contact with a rear face of the substrate when held by said top ring;

a regulator operable to regulate a temperature control fluid to be supplied into said air bag;

a flow regulating valve operable to regulate a flow rate of the temperature control fluid when discharged from said air bag; and a thermometer provided in said air bag to measure a temperature of the substrate when held by said top ring.

2. The substrate holding apparatus as recited in claims 1, wherein said thermometer is to monitor the temperature of the substrate when held by said top ring, and the substrate is to be controlled in terms of its temperature based on the temperature as monitored by said thermometer.

3. The substrate holding apparatus as recited in claim 2, wherein the substrate is to be controlled in terms of its temperature, based on the temperature as monitored by said thermometer, by operating said flow regulating valve such that regulated is the flow rate of the temperature control fluid when discharged from said air bag.

4. The substrate holding apparatus as recited in claim 1, wherein said air bag comprises a close-type air bag or an open-type air bag.

5. The substrate holding apparatus as recited in claim 1, further comprising:

a supply passage for supplying the temperature control fluid into said air bag, said regulator being in said supply passage; and a discharge passage for discharging the temperature control fluid from said air bag, said flow regulating valve being in said discharge passage.

6. The substrate holding apparatus as recited in claim 5, wherein said flow regulating valve is operable to regulate the flow rate of the temperature control fluid, when discharged from said air bag, so as to control a temperature of the substrate when held by said top ring and pressed against the polishing surface.

7. The substrate holding apparatus as recited in claim 1, wherein said flow regulating valve is operable to regulate the flow rate of the temperature control fluid, when discharged from said air bag, so as to control a temperature of the substrate when held by said top ring and pressed against the polishing surface.

8. A substrate holding apparatus comprising:

a top ring configured to hold a substrate to be polished, and press the substrate against a polishing surface;

an air bag attached to said top ring so as to be brought into contact with a rear face of the substrate when held by said top ring, said air bag including chambers;

regulators operable to regulate temperature control fluids to be supplied into said chambers, respectively;

flow regulating valves operable to regulate flow rates of the temperature control fluids, respectively, when discharged from said chambers; and a thermometer provided in said air bag to measure a temperature of the substrate when held by said top ring.

9. The substrate holding apparatus as recited in claim 8, wherein said thermometer is to monitor the temperature of the substrate when held by said top ring, and the substrate is to be controlled in terms of its temperature based on the temperature as monitored by said thermometer.

10. The substrate holding apparatus as recited in claim 9, wherein the substrate is to be controlled in terms of its temperature, based on the temperature as monitored by said thermometer, by operating said flow regulating valves such that regulated are the flow rates of the temperature control fluids when discharged from said chambers, respectively.

11. The substrate holding apparatus as recited in claim 8, wherein said air bag comprises a close-type air bag or an open-type air bag.

12. The substrate holding apparatus as recited in claim 8, wherein said chambers include a chamber located above a central portion of the substrate and a chamber located above a peripheral portion of the substrate, when the substrate is held by said top ring.

13. The substrate holding apparatus as recited in claim 12, wherein said chamber located above the central portion of the substrate, when held by said top ring, is to be supplied with a temperature control fluid cooled more intensively than a temperature control fluid to be supplied into said chamber located above the peripheral portion of the substrate, when held by said top ring.

14. The substrate holding apparatus as recited in claim 8, further comprising:

supply passages for supplying the temperature control fluids into said chambers, respectively, said regulators being in said supply passages, respectively; and discharge passages for discharging the temperature control fluids from said chambers, respectively, said flow regulating valves being in said discharge passages, respectively.

15. The substrate holding apparatus as recited in claim 14, wherein said flow regulating valves are operable to regulate the flow rates of the temperature control fluids, when discharged from said chambers, respectively, so as to control a temperature of the substrate when held by said top ring and pressed against the polishing surface.

16. The substrate holding apparatus as recited in claim 8, wherein said chambers include chambers divided in a radial direction of the substrate when held by said top ring.

17. The substrate holding apparatus as recited in claim 8, wherein said chambers are to be supplied with temperature control fluids cooled independently of each other.

18. The substrate holding apparatus as recited in claim 8, wherein said flow regulating valves are operable to regulate the flow rates of the temperature control fluids when discharged from said chambers, respectively, so as to control a temperature of the substrate when held by said top ring and pressed against the polishing surface.

* * * * *